United States Patent [19]

Dvoracek et al.

[11] 4,319,063

[45] Mar. 9, 1982

[54] PROCESS AND COMPOSITIONS FOR REDUCING FOULING OF HEAT EXCHANGE SURFACES

[75] Inventors: Louis M. Dvoracek, Brea; Paul W. Fischer, Fullerton; Milan Skripek, Fullerton, all of Calif.

[73] Assignee: Union Oil Company of California, Los Angeles, Calif.

[21] Appl. No.: 958,164

[22] Filed: Nov. 6, 1978

[51] Int. Cl.[3] ..... C01G 9/12

[52] U.S. Cl. ..... 585/4; 252/401; 252/402; 252/8.3; 252/8.55 B; 208/48 AA; 422/7; 585/5; 106/14.42; 106/14.43; 106/14.31

[58] Field of Search ..... 252/402, 8.55 B, 8.3, 252/401, 381, 384, 380, 390, 391; 208/48 AA; 166/304; 260/666.5; 422/7; 44/63, 64, 80; 106/15 R, 14.26, 14.31, 14.42, 14.43; 585/4, 5

[56] References Cited

U.S. PATENT DOCUMENTS

| | | | |
|---|---|---|---|
| 3,640,824 | 2/1972 | Bucaram | 252/8.3 |
| 3,668,111 | 6/1972 | Dvoracek | 208/48 |
| 3,763,018 | 10/1973 | Raff et al. | 585/4 |
| 3,776,835 | 12/1973 | Dvoracek | 208/48 AA |
| 4,226,700 | 10/1980 | Broom | 585/4 X |

*Primary Examiner*—J. L. Barr

*Attorney, Agent, or Firm*—Dean Sandford; Richard C. Hartman; Gregory F. Wirzbicki

[57] ABSTRACT

Fouling of metallic surfaces contacted with petroleum oils at elevated temperatures is reduced by adding to the oil small amounts of an oil-soluble N-alkylamino-alkylbenzene sulfonate, a heterocyclic amine, and phenylhydrazine.

25 Claims, 4 Drawing Figures

PROCESS AND COMPOSITIONS FOR REDUCING FOULING OF HEAT EXCHANGE SURFACES

BACKGROUND OF THE INVENTION

In processing petroleum oils it is almost invariably necessary to heat the oil to an elevated temperature by contacting it with a heated metal surface, e.g., by flowing it through a heating device such as a tube-and-shell heat exchanger or through the tubes of a direct-fired heater. Many petroleum oils, however, tend to foul metal surfaces with which they come in contact at elevated temperatures by depositing thereon solid or semi-solid materials such as inoganic salts, coke, tars, polymers and other carbonaceous matter. Such fouling materially reduces the efficiency of heat transfer from the metal surface to the oil, thereby increasing the amount of fuel required to heat the oil to the desired temperature. It also reduces the hydraulic capacity of the heat exchange equipment (thereby increasing the amount of energy required to pass the oil through the equipment) and in aggravated cases may render it impossible to maintain the desired flow rate.

The object of the present invention is to provide a means for reducing the fouling of metal surfaces which are contacted with a petroleum oil at elevated temperatures, and also to provide compositions of matter capable of inhibiting the aforesaid fouling tendency of petroleum oils.

SUMMARY OF THE INVENTION

Figure 1:
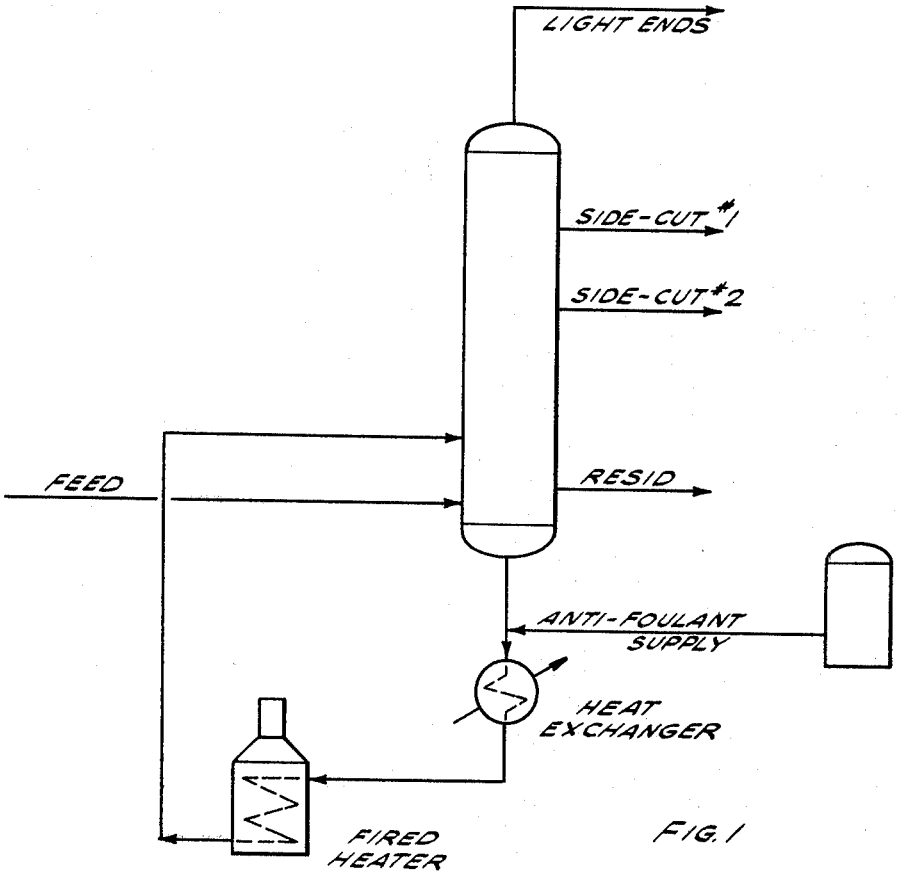
FIG. 1 is a schematic diagram of a crude oil distillation system typical of those in which fouling occurs.

The present invention consists in reducing the tendency of a petroleum oil to foul metallic surfaces with which it comes in contact at elevated temperature by adding to such oil: (i) an oil-soluble N-alkylamino-alkylbenzene sulfonate (ii) a heterocyclic amine, and (iii) phenylhydrazine. The additive materials may be added to the oil individually in any order or, preferably, are pre-mixed to form an anti-foulant composition which can be continuously metered into the oil in the desired amount. As is hereinafter more fully set forth, such compositions may comprise an inert diluent in addition to the three essential components.

DETAILED DESCRIPTION OF THE INVENTION

The method and compositions of the invention may be applied with respect to any petroleum oil which tends to foul metal surfaces with which it comes in contact at an elevated temperature. For the most part, such oils are crude oils which deposit foulants when heated to temperatures at 300° F., and above. The invention is particularly applicable with respect to crude oils of Indonesian origin, e.g., Attaka, Miri and Sepinggan crudes, which characteristically deposit large amounts of foulants during distillation or other processing.

The oil-soluble N-alkylamino-alkylbenzene sulfonate employed in practicing the present invention may be any of a number of such compounds available commercially under various brand names, e.g., "Nalco 262" available from Nalco Chemical Co., and "Ninate 411" marketed by Stepan Chemical Co. Usually, the alkyl group attached to the benzene nucleus will contain from about 10 to about 20 carbon atoms, whereas the alkylamino group will contain from 1 to about 12 carbon atoms, and the entire molecule will have a molecular weight between about 300 and about 500, preferably between about 350 and about 450. Typical of such compounds is an N-alkylamino-dodecylbenzene sulfonate having a molecular weight of about 395 sold under the name "Ninate 411". The amount in which the N-alkyklamino-alkylbenzene sulfonate is added to the oil, either as such or in combination with the other additive chemicals of the invention, will depend upon the degree to which the oil tends to deposit foulants at the temperature to which it is heated, but will usually be between about 2 and about 30 ppmw.

Typical of the heterocyclic amines employed in practicing the invention are morpholine, pyridine, piperazine, and their alkylated counterparts, e.g., methyl-morpholine, ethyl-piperazine, methyl-pyridine, etc. Morpholine is preferred because of its lower cost. Again, the amount in which the heterocyclic amine is added to the oil depends on the fouling characteristics of the latter; usually, however, such amount will be between about 5 and about 50, preferably between about 5 and about 20 ppmw.

The phenylhydrazine additive is usually added to the oil in an amount between about 5 and about 50 ppmw, preferably between about 5 and 20 ppmw, but the optimum amount will depend upon the identity of the oil and the temperature to which it is heated.

As previously stated, the invention further consists in anti-foulant compositions comprising the aforementioned additive chemicals. Such compositions are prepared simply by admixing said chemicals together in the following proportions:

| Additive Chemical | Percent by Weight |
|---|---|
| N-alkylamino-alkylbenzene sulfonate | 10-30, preferably 15-25. |
| Heterocyclic Amine | 20-60, preferably 30-50. |
| Phenylhydrazine | 20-60, preferably, 30-50. |

For convenience in handling it is preferred that the above compositions be diluted with an inert solvent; light petroleum hydrocarbons such as gasoline, naphtha, kerosene and the like are preferred for this purpose. The dilute compositions will conveniently comprise between about 10 and about 90, preferably between about 30 and about 70, percent by weight of the additive chemicals described above, with the remainder consisting of the solvent.

The following example will illustrate the formulation and preparation of one of the anti-foulant compositions of the present invention, but is not to be construed as limiting the invention:

EXAMPLE 900 gallons of reformer naphtha having an ASTM endpoint of about 400° F., were charged to a tank fitted with a recirculating pump. 4000 pounds of phenylhydrazine which had been pre-heated to about 100° F. were then introduced into the suction side of the pump, and the mixture was circulated for about 5 hours. 2000 pounds of Ninate 411 which had likewise been heated to about 100° F., were then introduced into the suction side of the pump and circulation was continued for another 5 hours. Finally, 4000 pounds of morpholine were introduced into the suction side of the pump, and after an additional 5 hours circulation the composition was transferred to 55-gallon drums for shipment.

Referring now to FIG. 1 of the drawing, the same schematically shows a typical crude oil distillation unit in which the crude oil feed is introduced directly into the lower end of the distillation column in order to flash off light ends, with the remainder being drawn off the bottom and heated by being passed through a heat exchanger and a fired heater before being re-introduced into the column. As fitted for practice of the present invention, a supply tank for the anti-foulant composition and pump are provided for introducing the composition directly into the flashed oil immediately ahead of the heat exchanger.

Figure 2:
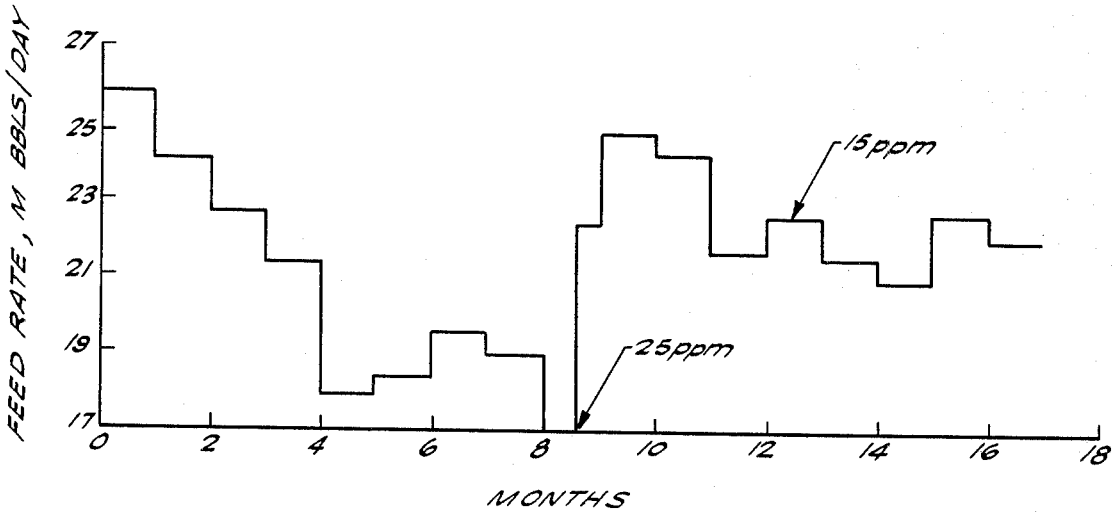
FIG. 2 graphically shows the improvement in feed rate attained by practice of the process of the present invention in the system of FIG. 1.
Figure 3:
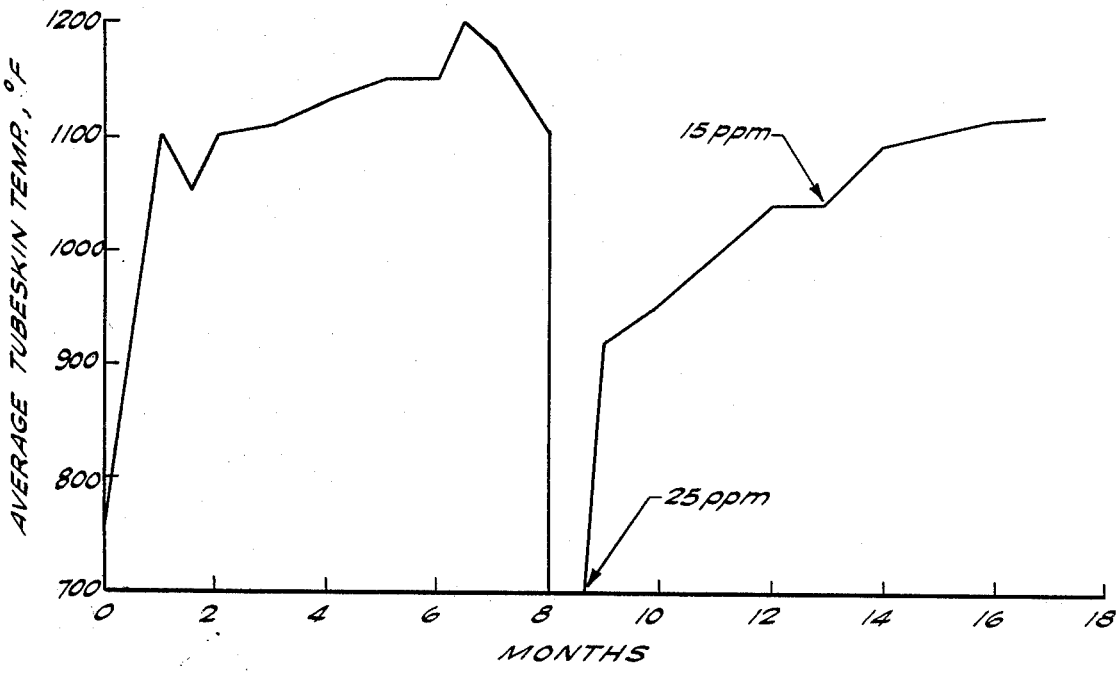
FIG. 3 graphically shows the reduction of heater tubeskin temperature attained by practice of the process of the present invention in the system of FIG. 1.
Figure 4:
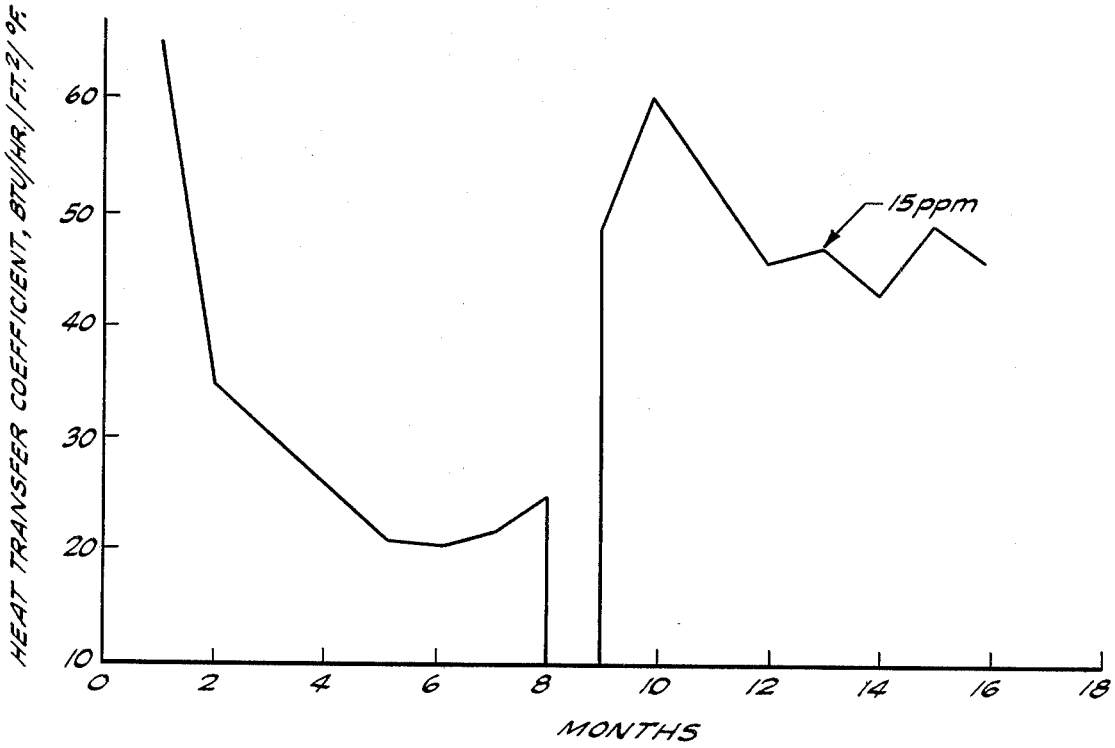
FIG. 4 graphically shows the improvement in the heat transfer coefficient in the heat exchanger of the system of FIG. 1 attained by practice of the process of the invention.

FIGS. 2, 3 and 4 show the operation of the system of FIG. 1 over a 17-month period during which it was operated on Indonesian and other crudes having a tendency to foul heated metal surfaces. During the first 8 months of operation, no anti-foulant composition was introduced into the system, and fouling occurred to such an extent that in order to achieve the desired distillate products it was necessary to reduce the feed rate from more than 25,000 barrels per day to 17,000–19,000 barrels per day and to provide so much heat from the direct fired heater that the average tubeskin temperature rose as high as 1200° F. Additionally, the heat transfer coefficient in the heat exchanger fell to about 20 BTU/hr.ft.$^2$/°F. At the end of the 8-month period, the unit was shut down for several weeks, and was then put back in service with the anti-foulant composition of the foregoing Example being introduced into the system in an amount sufficient to provide 25 ppm of anti-foulant in the stream fed to the heat exchanger. As a consequence, it became possible to operate the unit feedrates as high as 24,500 barrels per day, with average tubeskin temperature of the direct-fired heater reaching only about 1040° F., and the heat transfer coefficient in the exchanger averaging about 50. After 4 months operation in this manner, the anti-foulant concentration was reduced to 15 ppm. While such reduction caused a slight increase in the average tubeskin temperature and required a slight reduction in feedrate, after 4 months operation in such manner the unit was still capable of operation above its nominal design capacity with acceptable tubeskin temperatures and an average heat transfer coefficient of about 45 in the heat exchanger.

Other modes of applying the principle of our invention may be employed instead of those explained, provided the composition or the method defined by any of the following claims, or the equivalent of such defined compositions or methods, be produced or employed.

We claim:

1. A composition of matter useful as a foulant inhibitor in petroleum oils consisting essentially of between about 10 and 30 parts by weight of an oil-soluble N-alkylaminoalkylbenzene sulfonate, between about 20 and about 60 parts by weight of a heterocyclic amine selected from the group consisting of morpholine, pyridine, piperazine, and their methyl and ethyl derivatives, and between about 20 and about 60 parts by weight of phenylhydrazine.

2. A composition of matter useful as a foulant inhibitor in petroleum oils consisting essentially of between about 15 and about 25 parts by weight of an oil-soluble N-alkylaminoalkylbenzene sulfonate, between about 30 and about 50 parts by weight of a heterocyclic amine selected from the group consisting of morpholine, pyridine, piperazine, and their methyl and ethyl derivatives, and between about 30 and about 50 parts by weight of phenylhydrazine.

3. A composition of matter consisting essentially of the composition of claim 1 dissolved in a hydrocarbon solvent in a concentration of between about 10 and 90 percent by weight.

4. A composition of matter consisting essentially of the composition of claim 2 dissolved in a hydrocarbon solvent in a concentration of between about 30 and about 70 percent by weight.

5. The composition of claim 1, 2, 3, or 4 wherein the alkylamino-group of the N-alkylamino-alkylbenzene sulfonate contains between 1 and about 12 carbon atoms, the alkyl group attached to the benzene nucleus contains between about 10 and about 20 carbon atoms, and said N-alkylamino-alkylbenzene sulfonate has a molecular weight between about 300 and about 500.

6. The composition of claim 1, 2, 3, or 4 wherein the heterocyclic amine is morpholine.

7. The composition of claim 5 wherein the heterocyclic amine is morpholine.

8. A composition of matter useful as a foulant inhibitor in petroleum oils consisting essentially of a hydrocarbon solvent having dissolved therein a mixture of (i) between about 15 and about 25 parts by weight of an oil-soluble N-alkylamino-alkylbenzene sulfonate having a molecular weight between about 350 and 450 and in which the alkylamino group contains from 1 to about 12 carbon atoms and the alkyl group attached to the benzene nucleus contains from about 10 to about 20 carbon atoms, (ii) between about 30 and about 50 parts by weight of morpholine, and (iii) between about 30 and about 50 parts by weight of phenylhydrazine, said composition containing between about 30 and about 70 percent by weight of said mixture.

9. The composition of claim 3, 4, or 8 wherein said solvent is selected from the group consisting of gasoline, naphtha, and kerosene.

10. A petroleum oil composition having a reduced tendency for fouling at high temperatures comprising a petroleum oil having dissolved therein an N-alkylamino-alkylbenzene sulfonate, a heterocyclic amine selected from the group consisting of morpholine, pyridine, piperazine, and their methyl and ethyl derivatives, and phenylhydrazine.

11. A petroleum oil composition having a reduced tendency for fouling at elevated temperatures comprising a petroleum oil having dissolved therein phenylhydrazine, a heterocyclic amine selected from the group consisting of morpholine, pyridine, piperazine, and their ethyl and methyl counterparts, and an N-alkylamino-alkylbenzene sulfonate wherein the alkylamino group contains between about 1 and about 12 carbon atoms, the alkyl group attached to the benzene nucleus contains between about 10 and 20 carbon atoms, and said N-alkylamino-alkylbenzene sulfonate has a molecular weight between about 300 and about 500.

12. A petroleum oil composition as defined in claim 10 or 11 wherein said heterocyclic amine is morpholine.

13. A petroleum oil composition as defined in claim 12 wherein said phenylhydrazine is present in a proportion betweeen about 5 and 50 ppmw, morpholine between about 5 and about 50 ppmw, and said N-alkylamino-alkylbenzene sulfonate between about 2 and about 30 ppmw.

14. A petroleum oil composition as defined in claim 13 wherein said petroleum oil is a crude oil of Indonesian origin.

15. A petroleum oil composition as defined in claim 13 wherein said petroleum oil is an Attaka crude.

16. A petroleum oil composition as defined in claim 13 wherein said petroleum oil is a Miri crude.

17. A petroleum oil composition as defined in claim 13 wherein said petroleum oil is a Sepinggan crude.

18. A petroleum oil composition as defined in claim 10 or 23 containing phenylhydrazine in a proportion between about 5 and 50 ppmw, the heterocyclic amine between about 5 and about 50 ppmw, and said N-alkylamino-alkylbenzene sulfonate between about 2 and about 30 ppmw.

19. A petroleum oil composition as defined in claim 18 wherein said petroleum oil comprises a crude oil of Indonesian origin.

20. A petroleum oil composition having a reduced tendency for fouling at elevated temperatures comprising a petroleum oil having dissolved therein phenylhydrazine, morpholine, and an N-alkylamino-alkylbenzene sulfonate wherein the alkylamino group contains between about 1 and 12 carbon atoms, and the alkyl group attached to the benzene nucleus contains between about 10 and 20 carbon atoms, and said N-alkylamino-alkylbenzene sulfonate has a molecular weight between about 350 and about 450.

21. A petroleum oil composition as defined in claim 20 containing phenylhydrazine in a proportion between about 5 and 50 ppmw, morpholine between about 5 and about 50 ppmw, and said N-alkylamino-alkylbenzene sulfonate between about 2 and about 30 ppmw.

22. A petroleum oil composition as defined in claim 21 or 22 wherein said petroleum oil comprises a crude oil of Indonesian origin.

23. A petroleum oil composition as defined in claim 21 or 22 wherein said petroleum oil comprises an Attaka crude.

24. A petroleum oil composition as defined in claim 21 or 22 wherein said petroleum oil comprises a Miri crude.

25. A petroleum oil composition as defined in claim 21 or 22 wherein said petroleum oil comprises a Sepinggan crude.

* * * * *

UNITED STATES PATENT AND TRADEMARK OFFICE

CERTIFICATE OF CORRECTION

PATENT NO. : 4,319,063

DATED : March 9, 1982

INVENTOR(S) : Louis M. Dvoracek, Paul W. Fischer, Milan Skripek

It is certified that error appears in the above—identified patent and that said Letters Patent is hereby corrected as shown below:

In column 5, line 21, in Claim 18, the "23" should read -- 11 --.

In column 6, line 17, in Claim 22, delete "or 22".

Signed and Sealed this

*Tenth* Day of *August 1982*

[SEAL]

*Attest:*

GERALD J. MOSSINGHOFF

*Attesting Officer*

*Commissioner of Patents and Trademarks*